US009803421B2

(12) United States Patent
Craney

(10) Patent No.: US 9,803,421 B2
(45) Date of Patent: Oct. 31, 2017

(54) DOOR, IN PARTICULAR VERTICAL-LIFT DOOR, FOR CLOSING AN OPENING IN A WALL WHICH SEPARATES TWO DIFFERENT TEMPERATURE ZONES FROM ONE ANOTHER

(71) Applicant: Troodon Torsysteme GmbH, Melle (DE)

(72) Inventor: Jens Craney, Melle (DE)

(73) Assignee: Troodon Torsysteme GmbH, Melle (DE)

( * ) Notice: Subject to any disclaimer, the term of this patent is extended or adjusted under 35 U.S.C. 154(b) by 0 days.

(21) Appl. No.: 14/828,627

(22) Filed: Aug. 18, 2015

(65) Prior Publication Data

US 2016/0053536 A1 Feb. 25, 2016

(30) Foreign Application Priority Data

Aug. 21, 2014 (DE) ..... 10 2014 012 225

(51) Int. Cl.
*A47G 5/02* (2006.01)
*E06B 9/58* (2006.01)
(Continued)

(52) U.S. Cl.
CPC ..... *E06B 9/58* (2013.01); *E06B 1/52* (2013.01); *E06B 3/44* (2013.01); *E06B 3/80* (2013.01);
(Continued)

(58) Field of Classification Search
CPC .... E06B 9/08; E06B 9/11; E06B 2009/17069; E06B 9/17076; E06B 2009/2458
(Continued)

(56) References Cited

U.S. PATENT DOCUMENTS 1,583,133 A * 5/1926 Fierman ..... E06B 9/54 160/245
2,328,257 A * 8/1943 Butts ..... A47H 23/02 160/121.1
(Continued)

FOREIGN PATENT DOCUMENTS

DE 4438769 A1 2/1996
DE 102010020693 A1 11/2011
(Continued)

OTHER PUBLICATIONS

European Patent Office, Europaischer Recherchenbericht (patent search on related application), dated Jan. 7, 2016.
(Continued)

*Primary Examiner* — Katherine Mitchell
*Assistant Examiner* — Johnnie A Shablack
(74) *Attorney, Agent, or Firm* — Laurence P. Colton; Smith Tempel Blaha LLC

(57) ABSTRACT

A door, in particular vertical-lift door, for closing an opening in a wall, in particular in a wall which separates two different temperature zones from one another, having a movable, flexible door leaf which comprises multiple separate, flexible door leaf layers which are guided such that they are spaced apart from one another in the closed state of the door, and having at least one winding shaft onto which the door leaf can be wound up in order to open the door, in which two adjacent door leaf layers are connected to one another by at least one spacer which ensures a spacing, defined by the spacer, of the two door leaf layers at least in the region of the spacer in the closed state of the door.

6 Claims, 3 Drawing Sheets

(51) Int. Cl.

| | |
|---|---|
| ***E06B 9/08*** | (2006.01) |
| ***E06B 1/52*** | (2006.01) |
| ***E06B 3/44*** | (2006.01) |
| ***E06B 3/80*** | (2006.01) |
| ***E06B 5/00*** | (2006.01) |
| ***E06B 9/42*** | (2006.01) |
| ***E06B 9/68*** | (2006.01) |
| *E06B 9/24* | (2006.01) |
| *E06B 9/40* | (2006.01) |
| *F25D 23/02* | (2006.01) |

(52) U.S. Cl.
CPC ..... *E06B 5/00* (2013.01); *E06B 9/08* (2013.01); *E06B 9/42* (2013.01); *E06B 9/582* (2013.01); *E06B 9/68* (2013.01); *E06B 2009/2458* (2013.01); *E06B 2009/405* (2013.01); *F25D 23/02* (2013.01)

(58) Field of Classification Search
USPC ..... 160/241
See application file for complete search history.

(56) References Cited

U.S. PATENT DOCUMENTS 3,231,006 A * 1/1966 Fisher ..... E06B 9/13 160/269
3,450,186 A * 6/1969 Caffa ..... A01G 9/14 160/241
4,151,871 A * 5/1979 Ryan ..... E06B 9/24 160/120
4,194,550 A * 3/1980 Hopper ..... A47H 23/06 160/107
4,237,956 A * 12/1980 Sivin ..... E06B 9/40 126/569
4,275,645 A * 6/1981 Ruff ..... A47F 3/0469 160/120
4,313,484 A * 2/1982 Shore ..... E06B 9/24 160/121.1
4,344,473 A * 8/1982 Shore ..... E06B 9/24 160/121.1
4,407,267 A * 10/1983 Heden ..... A01G 9/22 126/629
4,408,650 A * 10/1983 Verch ..... E06B 9/24 160/121.1
4,453,584 A * 6/1984 Steele ..... E06B 9/24 160/121.1
4,583,517 A * 4/1986 Hilton ..... F24B 1/192 126/502
4,610,292 A * 9/1986 Hausmann ..... E06B 9/24 160/120
5,010,943 A * 4/1991 Boyer ..... B60P 3/205 160/351
5,365,990 A * 11/1994 Ueda ..... E06B 9/15 160/133
5,538,065 A * 7/1996 Géraud ..... A47H 23/06 160/120
5,862,851 A * 1/1999 Stoebich ..... A62C 2/10 160/120
6,357,507 B1 * 3/2002 Stoebich ..... A62C 2/10 160/121.1
6,659,158 B2 * 12/2003 Laugenbach ..... E06B 9/13 160/133
7,281,561 B2 * 10/2007 Anderson ..... E06B 9/264 160/121.1
7,938,162 B2 * 5/2011 Duineveld ..... E06B 9/64 160/121.1
8,074,697 B2 * 12/2011 Iglesias Ballester ... E06B 9/063 160/133
8,113,266 B2 * 2/2012 Cloninger ..... A62C 2/10 160/11
8,695,677 B2 * 4/2014 Kraeutler ..... E06B 9/063 160/266
8,733,420 B2 * 5/2014 Craney ..... E06B 9/08 160/241
8,800,632 B2 * 8/2014 Cooper ..... A62C 2/10 160/120
8,820,386 B2 * 9/2014 Mullet ..... E06B 9/40 160/133
9,259,833 B2 * 2/2016 Bonini ..... E06B 9/42
2002/0059985 A1 * 5/2002 Stoebich ..... A62C 2/10 160/41
2007/0193698 A1 * 8/2007 Kraeutler ..... E06B 9/063 160/36
2009/0278703 A1 * 11/2009 Iglesias Ballester ..... E06B 9/11 340/1.1
2011/0011542 A1 * 1/2011 Kuroi ..... G03B 21/58 160/133
2011/0265959 A1 * 11/2011 Frede ..... E06B 9/17076 160/133
2012/0043029 A1 * 2/2012 Gaskill ..... E06B 9/42 160/121.1
2012/0111507 A1 * 5/2012 Craney ..... E06B 9/08 160/120
2012/0318465 A1 * 12/2012 Colson ..... E06B 9/262 160/7
2014/0090788 A1 * 4/2014 McDonald ..... E06B 3/483 160/193
2016/0053530 A1 * 2/2016 Craney ..... E05D 15/16 160/127
2016/0053536 A1 * 2/2016 Craney ..... E06B 5/00 160/241

FOREIGN PATENT DOCUMENTS

| | | | |
|---|---|---|---|
| EP | 1327842 | A2 | 7/2003 |
| FR | 2936006 | A1 | 3/2010 |
| GB | 2463154 | A | 3/2010 |

OTHER PUBLICATIONS

Deutsches Patent—Und Markenamt (German Patent and Trademark Office), Recherchebericht (Search on related application), dated Nov. 13, 2015.
European Patent Office, Submission of 3rd Party Comments and Observations (on a related application), dated Dec. 1, 2016.

* cited by examiner

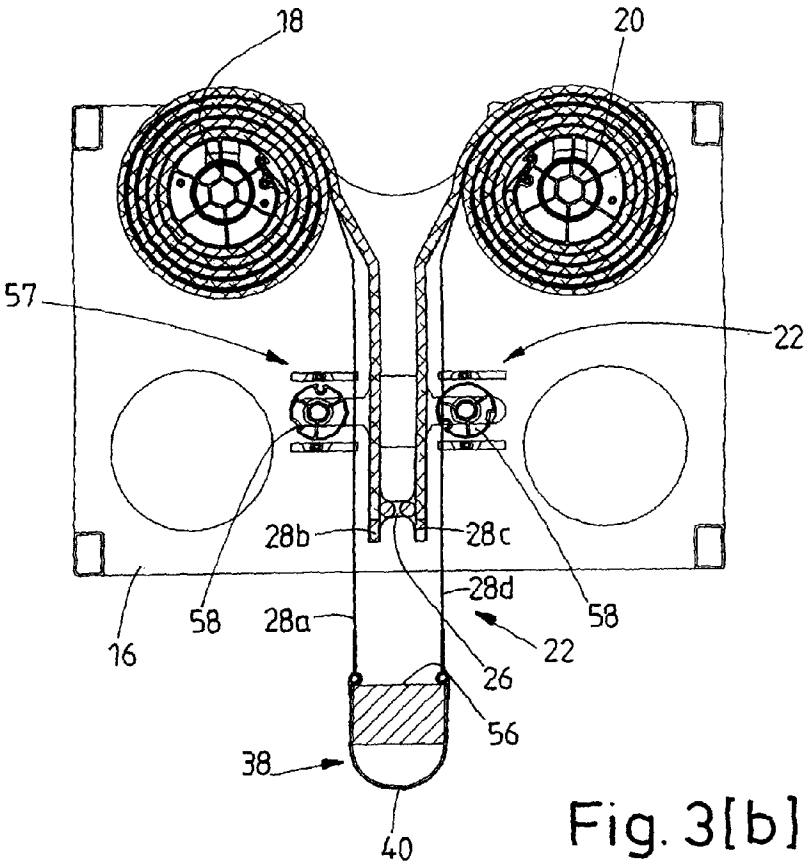
Fig. 3[b]
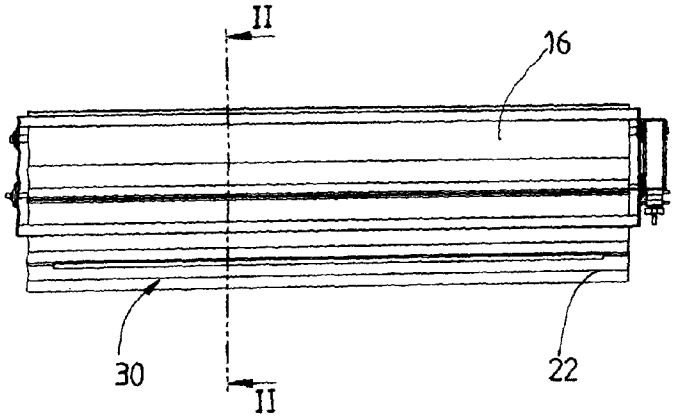
Fig. 3[a]

DOOR, IN PARTICULAR VERTICAL-LIFT DOOR, FOR CLOSING AN OPENING IN A WALL WHICH SEPARATES TWO DIFFERENT TEMPERATURE ZONES FROM ONE ANOTHER

STATEMENT OF RELATED APPLICATIONS

This patent application claims priority on and the benefit of German Patent Application No. 10 2014 012 225.5 having a filing date of 21 Aug. 2014.

BACKGROUND OF THE INVENTION

Technical Field

The present invention relates to a door, in particular vertical-lift door, for closing an opening in a wall, in particular in a wall which separates two different temperature zones from one another, having a movable, flexible door leaf which comprises multiple separate, flexible door leaf layers which are guided such that they are spaced apart from one another in the closed state of the door, and having at least one winding shaft onto which the door leaf can be wound up in order to open the door.

Prior Art

A door of said type is presented in DE 10 2010 020 693 A1. The door has two winding shafts onto which the door leaf is wound up. The door leaf of the door has inter alia two outer layers and two insulation layers arranged between said outer layers. In this case, one outer layer and one insulation layer are assigned to one winding shaft, and the other outer layer together with the other insulation layer are assigned to the other winding shaft. During the closing of the door, all of the abovementioned door leaf layers are guided by rollers or the like such that they are spaced apart from one another in the closed state of the door. It has however been found that, during rapid unwinding of the door, transverse force components cause the two insulation layers to initially disadvantageously swing back and forth, and possibly abut against one another, until they have reached their stable end position.

BRIEF SUMMARY OF THE INVENTION

It is an object of the invention to further develop the door mentioned in the introduction.

Said object is achieved by means of a door, in particular vertical-lift door, for closing an opening in a wall, in particular in a wall which separates two different temperature zones from one another, having a movable, flexible door leaf which comprises multiple separate, flexible door leaf layers which are guided such that they are spaced apart from one another in the closed state of the door, and having at least one winding shaft onto which the door leaf can be wound up in order to open the door, characterized in that two adjacent door leaf layers are connected to one another by at least one spacer which ensures a spacing, defined by the spacer, of the two door leaf layers at least in the region of the spacer in the closed state of the door.

Accordingly, the door is characterized in that two adjacent door leaf layers are connected to one another by at least one spacer which ensures a defined spacing of the two door leaf layers by way of the spacer in the closed state of the door. This prevents inter alia a situation in which the spacing between the two separate, adjacent door leaf layers is disadvantageously changed, by forces acting transversely with respect to the door leaf plane, during rapid closing of the door, that is to say unwinding of the door leaf layers from the one or more winding shafts. Possible collisions of said door leaf layers are prevented in an effective manner.

In other words, the spacer holds two door leaf layers which are separate and adjacent, that is to say arranged in immediate succession in the sequence of door leaf layers (with regard to the sequence transversely with respect to the door leaf plane in the closed state of the door), spaced apart by the spacing predefined by the spacer. This applies at any rate in the region in which the spacer is arranged. If, in the case of a vertical-lift door, the spacer is arranged for example in the region of the lower or free ends of the adjacent door leaf layers, the spacing between said door leaf layers can be defined by the spacer in particular in said lower region. Further upward, it would be possible for rollers or guide means to influence or predefine the respective position of the respective layer so as to be able to (at least jointly) define the spacing between the door leaf layers.

It is however basically also conceivable for multiple spacers to be provided between the adjacent door leaf layers, which spacers are spaced apart from one another in terms of position and (in the closed state of the door) ensure a defined spacing between the adjacent layers over the entire extent of the door leaf. Here, it is at least theoretically also conceivable for different spacers to be used which each ensure different spacings between the door leaf layers across the door leaf plane.

The spacer is advantageously arranged in the region of free ends of the two adjacent door leaf layers, in particular with a (small) spacing to said free ends.

In a further embodiment of the invention, the spacer extends substantially along the entire width of the door leaf or of the two adjacent door leaf layers, preferably substantially parallel to free ends of the two door leaf layers.

The spacer may for example have two (preferably elongate) spacer parts, wherein one (elongate) spacer part is arranged on one door leaf layer, in particular on that side of said door leaf layer which faces toward the adjacent door leaf layer, and the other spacer part is arranged on the other door leaf layer, in particular on that side of said other door leaf layer which faces toward the adjacent door leaf layer, and wherein the two spacer parts are connected to one another, in particular by way of a screw connection.

The door is preferably in the form of a vertical-lift door, wherein the door leaf thereof has two outer layers and two insulation layers arranged between the two outer layers, and wherein the spacer is assigned to the two insulation layers such that it ensures a spacing, defined by the spacer, between the insulation layers in the closed state of the door.

In a further embodiment of the invention, the door has two opposite, parallel winding shafts, wherein one of the adjacent door leaf layers is assigned to one winding shaft and the other adjacent door leaf layer is assigned to the other winding shaft.

The door preferably has a winding shaft housing, in which the one or more winding shafts on which the door leaf (leaves) is/are wound up is or are arranged. In this case, the winding shaft housing may be of thermally insulating form through the use of heat-insulating materials.

It is achieved in this way that heat situated within the winding shaft housing does not have to flow into the surroundings through the housing walls without being utilized, and instead can be used in targeted fashion to keep the door leaf of the door free from ice.

In general, in the winding shaft housing, there is arranged at least one mechanical drive which generates waste heat during the operation of the door, in particular at least one motor (in particular an electric motor) for driving the winding shaft(s). It has surprisingly been found that, if the waste heat thereof is used in targeted fashion and conducted in the direction of the door leaf, it may be possible, during the operation of the door, for the door leaf to be kept completely free from ice, without the imperative need for an additional heater.

The door leaf may advantageously be fastened to the one or more winding shafts such that, at least in the closed state of the door, the space between at least two (in this closed state) mutually spaced-apart door leaf layers, in particular between two insulation layers, is connected in air-conducting and heat-conducting fashion to the interior of the winding shaft housing, such that a heat flow is possible between said space and the winding shaft housing.

Expediently, to achieve this aim, the thermal insulation of the winding shaft housing, the thermal insulation of the door leaf and if appropriate the thermal insulation of at least one further (sub-)housing, which is connected in heat-conducting fashion by way of at least one air duct to the door leaf or to the winding shaft housing, of the door should be designed such that, in accordance with the expected (maximum) temperature difference between the two temperature zones to be thermally separated by the door in situ, in accordance with the average waste heat generated by the at least one drive that is used, and if appropriate, in accordance with further components that generate waste heat in the winding shaft housing, a proportion of the waste heat which is generated can pass into the (entire) space between the two door leaf layers, which proportion of the waste heat keeps the door leaf free from ice.

The winding shaft housing of the door may in this case be of thermally insulating form by virtue of the winding shaft housing being formed entirely or partially from heat-insulating material, in particular several or all (outer) walls of the winding shaft housing. It is also possible in particular for several or all (outer) walls of said winding shaft housing to have at least one layer composed of a heat-insulating material. Provision may also be made for heat-insulating material to be arranged within the winding shaft housing.

In a particularly preferred embodiment of the invention, one, several or all walls of the winding shaft housing are insulation panels (industrial isolation panels) or are formed therefrom. These may in each case be constructed from two opposite steel sheets, between which there is arranged in particular dimensionally stable heat-insulating material. The heat-insulating material may be PUR or PIR, in particular in panel form.

The winding shaft housing is advantageously insulated so as to have a U value, that is to say a heat transfer coefficient, of (on average) less than 1.0 $W/m^2K$, preferably less than 0.8 $W/m^2K$, particularly preferably less than 0.4 $W/m^2K$. Said heat transfer coefficient may in particular lie in a range between 0.5 $W/m^2K$ and 0.2 $W/m^2K$, particularly preferably between 0.4 $W/m^2K$ and 0.3 $W/m^2K$.

The winding shaft housing is preferably formed so as to be substantially closed (in air-tight fashion) with the exception of a slot which is arranged on one side, in particular on the underside, and through which the door leaf is guided from the inside to the outside.

In the practical implementation of the invention, it is furthermore possible for at least one further (sub-)housing of the door to be of thermally insulating form in the same way through the use of heat-insulating material, for example a (sub-)housing in which the door leaf is laterally guided during the closing or opening movement. This preferably applies to all further (sub-)housings of the door. The requirements with regard to the corresponding U values of said (sub-)housings may expediently at least approximately correspond to those that apply in the case of the winding shaft housing.

If the door according to the invention is a vertical-lift door, it is for example possible for two side parts or two side part housings, in which the lateral edges of the door leaf are guided, to preferably likewise be heat-insulated through the use of heat-insulating material.

The at least one further (sub-)housing may in this case for example likewise be formed from the abovementioned insulating panels.

It would furthermore alternatively or additionally be possible for the interior of the one or more further (sub-)housing(s) to be entirely or partially filled with insulation foam, for example with polystyrene foam.

On average, it would thus be possible for a (sub-)housing to have, for example, an overall heat conductivity value, that is to say a $\lambda$ value, of less than 0.3 W/mK, particularly preferably of less than 0.2 W/mK. The $\lambda$ value could for example lie between 0.1 and 0.2 W/mK.

As regards the door leaf, it may, in a refinement of the invention, have two outer layers which form the outer sides of the door leaf, said outer layers being composed in particular of plastic, such as for example PVC, and have at least one, preferably multiple insulation layers comprising heat-insulating material between these outer layers. In this case, all of said door leaf layers are guided such that, in the closed state of the door, they are spaced apart from one another, with the formation of corresponding intermediate spaces between in each case two adjacent door leaf layers.

It is preferably the case that, in the closed state of the door, at least one insulation layer, together with an adjacent layer arranged spaced apart from said insulation layer, in particular the adjacent outer layer of the door leaf, laterally (in the direction perpendicular to the door leaf plane, likewise in relation to the closed state of the door) delimits an air-filled intermediate space. The air situated in said air-filled intermediate space is substantially at rest or static in said closed state of the door, such that the intermediate space preferably acts as an additional air insulation layer.

In a further embodiment of this concept, it is provided that the two abovementioned layers of the door leaf are guided such that the insulation layer and the adjacent layer which together laterally delimit the air-filled intermediate space in the closed state of the door are assigned to one and the same winding shaft.

If the door has two winding shafts which are arranged in the winding shaft housing and which are preferably arranged in a common horizontal plane, a first insulation layer together with the layer adjacent thereto, with which said first insulation layer laterally delimits the air-filled intermediate space in the closed state of the door, may be assigned to one winding shaft, and a second insulation layer together with the layer adjacent thereto, with which said second insulation layer laterally delimits the air-filled intermediate space in the closed state of the door, may be assigned to the other winding shaft.

In a further preferred refinement of the invention, the adjacent layer is connected, in an end termination region, to a termination part (a lower termination part in the case of a vertical-lift door) which has a contact surface which runs in particular at an angle with respect to the plane in which the adjacent layer extends. A free terminating edge (a lower terminating edge in the case of a vertical-lift door) of the insulation layer bears, in particular with sealing action, against said contact surface in the closed state of the door.

In this case, the insulation layer and the adjacent layer may be guided such that the free terminating edge, which bears against the contact surface in the closed state of the door, of the insulation layer is spaced apart from the contact surface at least in phases during the winding-up of the two layers onto the winding shaft, that is to say during the opening of the door.

If the door is in the form of a vertical-lift door, the door leaf thereof may expediently have two outer layers and two insulation layers arranged between the two outer layers, wherein, between each insulation layer and the respectively adjacent outer layer, there is situated in each case one or the air-filled intermediate space, wherein the air contained in said air-filled intermediate space is in each case substantially static in the closed state of the door, and wherein, at least in the closed state of the door, the space between the adjacent insulation layers is connected in air-conducting and heat-conducting fashion, in the manner already indicated above, to the interior of the winding shaft housing, such that an air flow and a heat flow are possible between said space and the winding shaft housing.

As regards the door leaf, said door leaf is expediently guided along an adjustable guide device which preferably comprises one or more guide rollers and by means of which, for at least one of the layers of the door leaf, the horizontal position of the vertical plane along which the at least one door leaf layer is moved or is movable during the opening or closing of the door in the door opening plane can be varied.

For the adjustment of the horizontal position of the vertical movement plane of the at least one layer of the door leaf, the horizontal position of one or all of the guide rollers of the adjustable guide device can be varied.

An independent special feature of the invention, in particular a special feature of the invention that can possibly also be claimed independently, concerns the winding shaft(s). According thereto, (if appropriate in each case) the insulation layer assigned to the common winding shaft, on the one hand, and the layer adjacent to said insulation layer, on the other hand, which in the closed state of the door together laterally delimit the air-filled intermediate space arranged between them, are fastened to the winding shaft in different positions of the winding shaft as viewed in the circumferential direction of the latter.

BRIEF DESCRIPTION OF THE DRAWINGS

Further features of the present invention will emerge from the appended patent claims, from the following description of a preferred exemplary embodiment, and from the appended drawings, in which:

DETAILED DESCRIPTION OF PREFERRED EMBODIMENTS

Figure 1:
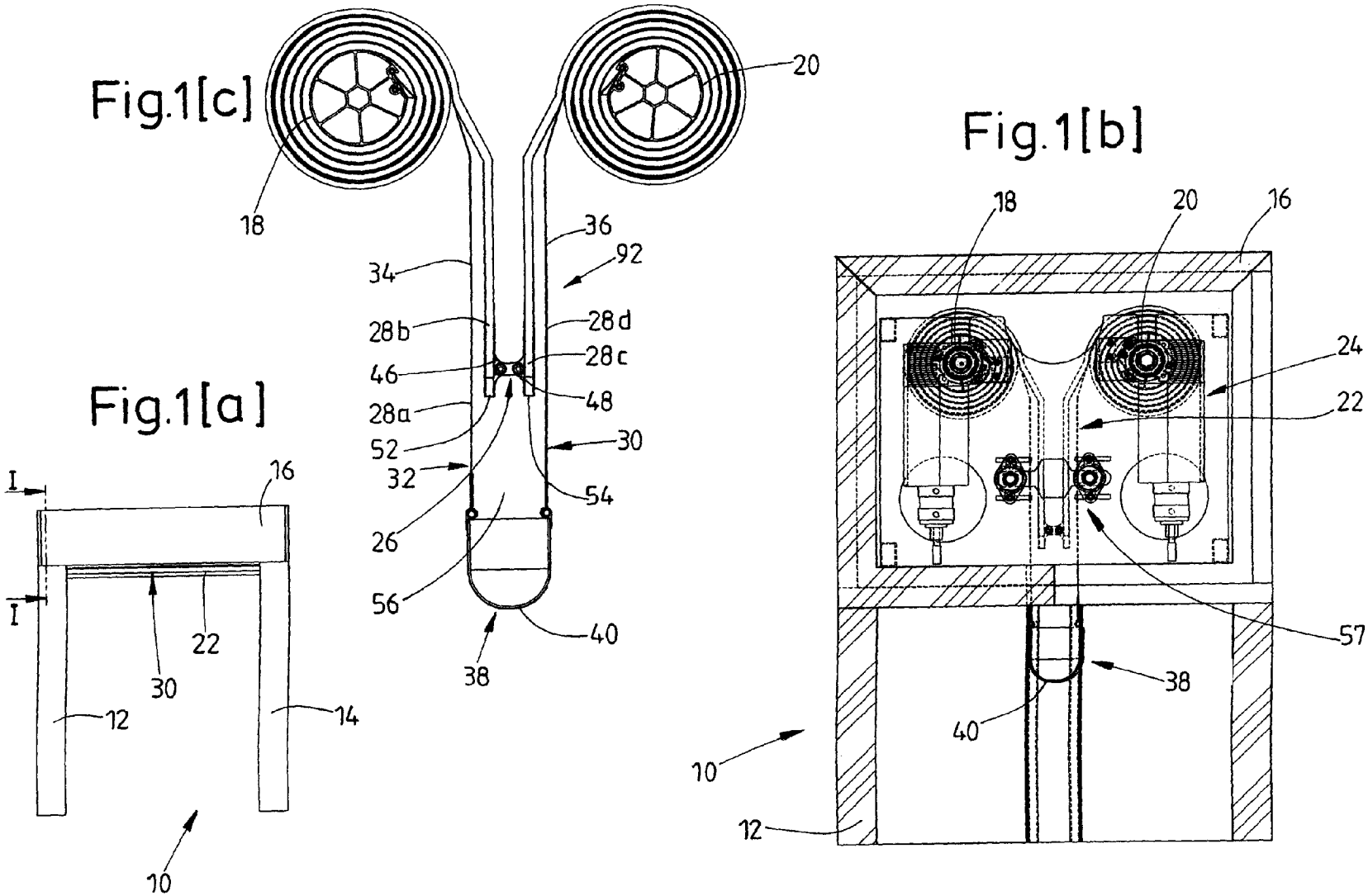
FIG. 1[*a*] shows a door according to the invention in a schematic front view, FIG. 1[*b*] shows the door from FIG. 1[*a*] in a partially sectional side view along the section line I-I from FIG. 1[*a*], FIG. 1[*c*] shows an isolated side view of the door leaf of the door from FIG. 1[*a*] and FIG. 1[*b*] in the partially open state in which it has been wound onto two opposite winding shafts.

The drawings show a door 10 according to the invention, in the present case a so-called high-speed roller door in the form of a vertical-lift door.

The door 10 serves for intermittently closing and opening up an opening (not illustrated) in a wall (not illustrated), for example in an outer wall of a building, preferably of a cold storage facility.

Temperatures prevailing in a cold storage facility of said type lie far below freezing point. In cold storage facilities, high-speed roller doors are used inter alia in order to be able to minimize the times in which the openings which are to be closed are opened up, for example in order to allow forklift trucks to pass through the openings. This is because, when the door is open, a large amount of heat energy enters the cold storage facility owing to the generally intense temperature gradient between the interior of the cold storage facility and the external surroundings. This must be prevented. A problem in the case of such high-speed roller doors of cold storage facilities is that the individual components thereof are subject to rapid icing. Icing can result in malfunctions.

In the case of the door 10 according to the invention, icing is substantially prevented.

The door 10 has side parts 12, 14 which are installed in the region of the vertical edges or sides of the wall opening (not illustrated). For this purpose, the side parts 12, 14 have self-standing support or installation frameworks (not shown in detail).

In the upper region of the wall opening there is arranged a winding shaft housing 16, or an upper part, which runs parallel to the upper edge of the wall opening and which, in the installed state, is (also) supported by the side parts 12, 14. In other words, the winding shaft housing 16 connects the side parts 12, 14 by lying on the top sides of the side parts 12, 14.

Various assemblies of the door 10, such as in the present case two winding shafts 18, 20 which run horizontally and parallel to one another with a spacing, are arranged in the interior of the winding shaft housing 16. It also falls within the invention for only one winding shaft to be used. The individual webs of a flexible door leaf 22 are in each case wound up onto said winding shafts 18, 20 in order to open the door 10, and unwound in order to close the door. The winding shaft housing 16 is designed to be closed on all sides, but on the underside has a slot through which the door leaf 22 emerges or can emerge from the housing 16 in a downward direction.

To set the winding shafts 18, 20 in suitable rotational motion, there is also arranged in the winding shaft housing 16 a gearing unit (not illustrated in any more detail) and a preferably electrically operated drive motor (not illustrated), the rotational movements of which are converted by the gearing unit into suitable rotational movements of the winding shafts. Furthermore, there is positioned in said winding shaft housing a control unit which controls inter alia the drive movements of the winding shafts 18, 20.

The door leaf 22 has individual, separate webs 28*a*-28*d*. In the closed state of the door leaf 22 (cf. FIG. 2), the webs 28*a-d* extend over the entire free area of the door opening running between the side parts 12, 14 and the winding shaft housing 16.

The webs 28*a*, 28*b* are in this case assigned to the winding shaft 18, and the webs 28*c*, 28*d* are assigned to the winding shaft 20. In other words, during the opening of the door 10, the webs 28*a*, 28*b* are wound up on the winding shaft 18 and the webs 28*c*, 28*d* are wound up on the winding shaft 20.

The front side 30 of the door leaf 22 is formed by the outer web 28*d*, and the rear side of the door leaf 22 is formed by the outer web 28*a*. Here, the material of the two outer webs 28*a*, 28*d* is in each case plastic, preferably PVC. This is however not imperative.

In the installed state, the door leaf 22 is oriented such that the front side 30 or the outer web 28*d* points into the interior of the cold storage facility (not illustrated), that is to say in the direction of the temperature zone which is colder than the external surroundings of the building.

In the closed state of the door 10, the webs 28*b*, 28*c* are arranged in the intermediate space between the front side 30 and the rear side 32 or between the outer webs 28*a*, 28*d*, with a spacing to one another and with a spacing to the webs 28*a* and 28*d*. All of the webs 28*a*-28*d* accordingly run substantially parallel to one another (with a spacing). This is achieved through suitable guide means along which the individual webs 28*a*-28*d* are guided. In the simplest case, said guide means may be rollers.

The webs 28*b* and 28*c* are in the form of insulation webs, that is to say they are in the present case composed of suitable flexible, heat-insulating material or each comprise such material, in particular a polymer-based, for example polyethylene-based, heat-insulating material. Here, the material in question preferably has a thermal conductivity value $\lambda$ of less than 0.09 W/mK, particularly preferably less than 0.045. Said value may in particular lie between 0.030 W/mK and 0.045 W/mK.

The lower edges or the lower end regions of the outer webs 28*a*, 28*d* are in each case connected to a common, lower termination part 38. Said termination part 38 is in the present case of elongate form and, in the closed state of the door 10, forms the lower termination of the door. Said termination part preferably has suitable heat insulation characteristics, in particular a U value of less than 1.8 $W/m^2K$. In general, the termination part 38, in particular the underside thereof, lies against a floor surface which delimits the wall opening in a downward direction, or alternatively hangs slightly above the floor surface with a small spacing to the latter.

The vertical, lateral edges of the door leaf 22, in particular the lateral edges 34, 36 of the outer webs 28*a* and 28*d* (to both sides of the door leaf 22), are guided in vertical guides or slots (merely indicated in the drawings) of the side parts 12 and 14.

What is of particular importance is a spacer 26. Said spacer is arranged in the region of the free ends of the adjacent insulation layers 28*b*, 28*c*, specifically between the insulation layers 28*b*, 28*c*. Said spacer has the purpose of holding the two layers 28*b*, 28*c* with a fixed, defined spacing to one another, in particular after said layers have been unwound from the winding shaft 18 or from the winding shaft 20, in the closed state of the door 10. This serves inter alia to prevent the adjacent layers 28*b*, 28*c* from abutting against one another or colliding with one another during a rapid unwinding of the door leaf 22.

In the present case, said spacer is arranged above the free ends of the insulation layer 28*b*, 28*c* with a spacing to the latter. Said spacer is of elongate form.

The spacer 26 extends substantially parallel to the free ends of the insulation layers 28*b*, 28*c*, specifically at least approximately over the full width of the insulation layers 28*b*, 28*c*. This is however not imperative.

In the present case, said spacer has an elongate first spacer part 26*a*, which is assigned to the insulation layer 28*b*, and a corresponding second spacer part 26*b*, which is assigned to the insulation layer 28*c*. In this case, the spacer parts 26*a* and 26*b* are arranged in each case on that side of the insulation layer 28*b* or 28*c* respectively which faces toward the respective other or adjacent insulation layer 28*b* or 28*c*.

The spacer parts 26*a* and 26*b* are in each case fastened to the insulation layers 28*b* and 28*c* respectively. Here, in the present case, the spacer part 26*a* is fastened to an (in the present case U-shaped) edge or termination profile 46, which is assigned to the insulation layer 28*b*, and the spacer part 26*b* is assigned to an (in the present case likewise U-shaped) edge or termination profile 48, which is assigned correspondingly to the insulation layer 28*c*.

In this case, the termination profiles 46, 48 are in each case assigned, and fastened, to the respective lower end of the insulation material of the insulation layer 28*b* or 28*c* respectively. Specifically, said termination profiles surround said respective lower end in each case.

The termination profiles 46, 48, and ultimately also the spacer 26, also serve for increasing the weight of the insulation layers 28*b*, 28*c*. It is therefore preferable, at any rate, for the spacer parts 26*a*, 26*b*, and possibly also the termination profiles 46, 48, to be manufactured from steel.

The spacer parts 26*a*, 26*b* are connected, in the present case screwed, to one another. For this purpose, use is made of transverse web parts 49 which extend between the spacer parts 26*a*, 26*b* and which connect these. Each transverse web part 49 is connected both to one and to the other spacer part 26*a* and 26*b*.

As can be seen in the drawings, in the closed state of the door 10, that is to say when the door leaf 22 has been substantially fully unwound from the winding shafts 18, 20, three intermediate spaces are formed between the door leaf layers 28*a-d:*

Firstly, a first intermediate space 50*a* is formed between the two insulation layers 28*b*, 28*c*. Said intermediate space 50*a* is open in an upward direction. Said intermediate space issues (in the upper end region) directly into the winding shaft housing 16, wherein said intermediate space widens in an upward direction in its end region (within the housing 16). In this way, this intermediate space is connected in air-conducting and heat-conducting fashion to the winding shaft housing 16.

Secondly, two intermediate spaces 50*b*, 50*c* are formed between in each case one insulation layer 28*b* or 28*c* respectively, at one side, and the respectively adjacent outer layer 28*a* or 28*d* respectively, at the other side. In this case, the intermediate spaces 50*b*, 50*c* are closed in an upward and downward direction in the closed state of the door.

In the present case, the intermediate spaces are closed in the upward direction because the layers of each layer pair 28*a*, 28*b* and 28*c*, 28*d* respectively which forms the intermediate spaces 50*b* and 50*c* respectively are assigned to one and the same winding shaft 18 and 20 respectively. In this way, the intermediate spaces 50*a* and 50*b* respectively each consequently narrow in an upward direction and are upwardly closed, as the layers of the respective layer pair are arranged one on top of the other, and are wound one on top of the other during the winding-up process, on the respective winding shaft 18 and 20 respectively.

Figure 2:
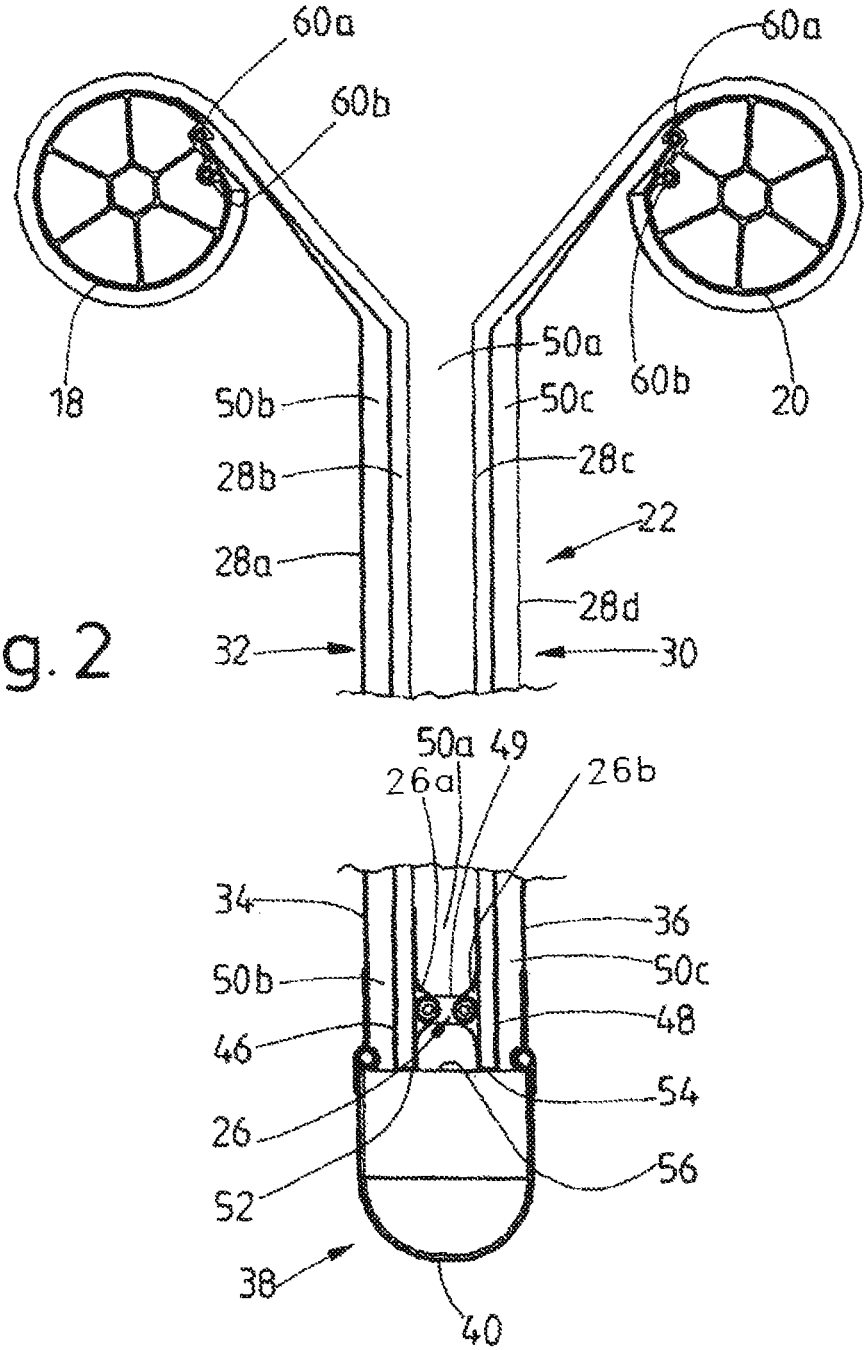
FIG. 2 shows the isolated side view of the door leaf corresponding to FIG. 1[*c*], but in the closed state in which it has been substantially unwound from the winding shafts, FIG. 3[*a*] shows a front view of a part of the door from FIG. 1[*a*], FIG. 3[*b*] shows a cross section along the section line II-II from FIG. 3[*a*].

In the downward direction, the intermediate spaces 50*b*, 50*c* are (in the present case only in the closed state of the door) likewise closed, cf. FIG. 2, by virtue of the guidance of the individual layers 28*a-d* being coordinated such that the lower ends or edges 52, 54 (over their entire length) bear in particular sealingly against, or lie sealingly on, a contact surface 56 which runs at an angle, in particular perpendicularly, with respect to the door leaf plane. In the present case, the contact surface 56 is a constituent part of the termination part 38; in particular, said contact surface is part of an upwardly pointing top side of said termination part.

The air situated in the intermediate spaces 50*b*, 50*c* in the closed state of the door 10 is to be regarded, in terms of insulation, as a substantially static air layer and—depending on the thickness of the respective intermediate space 50*b*, 50*c* or of the corresponding air layer—has corresponding U values. This ultimately also approximately applies to the air layer in the intermediate space 50*a*.

Consequently, the overall U value of the door leaf 22 (in the closed state) is determined by the individual U values of the outer layers 28*a*, 28*d*, of the insulation layers 28*b, c* and of the air layers in the intermediate spaces 50*a*, 50*b*, 50*c*.

As can be seen inter alia in FIG. 1[*c*], owing to the guidance of the layers 28*a-d*, the intermediate spaces 50*b*, 50*c* are no longer closed at the bottom during the opening of the door 10 or during the winding-up of the layers 28*a-d*. This is because the lower ends 52, 54 of the insulation layers 28*b*, 28*c* have moved away from the contact surface 56.

As regards the thickness of the individual layers 28*a-d* and of the intermediate spaces 50*a*, 50*b*, 50*c*, it has been found that each insulation layer 28*b*, 28*c* should preferably have a thickness (the dimension perpendicular to the door leaf plane in the closed state of the door) of between 5 mm and 50 mm, in particular between 10 mm and 35 mm. The insulation webs 28*b*, 28*c* are preferably guided such that the corresponding thickness of the intermediate space 50*a*, that is to say the spacing between the insulation layers 28*b*, 28*c*, is (in the closed state) between 15 mm and 80 mm, in particular between 20 mm and 55 mm. The insulation layers 28*b*, 28*c* are preferably guided relative to the layers 28*a* and 28*b* that are in each case adjacent thereto such that the thickness of the intermediate spaces 50*b*, 50*c* is in each case between 8 mm and 25 mm, in particular between 10 mm and 22 mm. Other values may however also be used.

It is particularly important then for the winding shaft housing 16 to be of thermally insulating form through the use of suitable heat-insulating material. In the present case, the outer walls of said winding shaft housing are manufactured entirely or partially from heat-insulating material, preferably from suitable industrial insulating panels.

By means of the heat insulation of the winding shaft housing 16, it is achieved that heat situated within the winding shaft housing 16 does not flow through the housing walls thereof to the surroundings without being utilized, and instead can be used in targeted fashion to keep the door leaf of the door free from ice. With corresponding design of the individual heat-insulated components of the door 10, in particular of the winding shaft housing 16 and of the door leaf 22, but possibly also additionally of the side parts 12, 14, which may likewise be of heat-insulating design, it may surprisingly be the case that—depending on the amount of waste heat generated by the drive, which is situated in the winding shaft housing, for the winding shafts during the provided door operation, and depending on the magnitude of the local temperature difference, that is to say the temperature difference prevailing at the location of the door, between the two temperature zones that the door is intended to separate—the waste heat of said drive suffices to be able to keep the door leaf possibly completely free from ice during the operation of the door, without the need for an additional heater.

In this case, the overall U value of the door 10 may, with corresponding design of the side parts 12, 14, of the door leaf 22 and of the winding shaft housing 16, be less than 0.8 $W/m^2K$; in particular, said value may lie between 0.8 $W/m^2K$ and 0.4 $W/m^2K$.

It is self-evidently possible for an additional, in particular electrically operated heater to be provided. Said heater could, if appropriate with temperature-dependent control, be activated in particular automatically, for example during times in which the door is not operated enough and thus little waste heat is generated by the drive, or during times in which the abovementioned temperature difference is greater than that which has previously been calculated. Said auxiliary heater could likewise be arranged in the winding shaft housing.

The heat generated by the drive and/or by the additional heater can at any rate exit the winding shaft housing 16 through the upper opening of the intermediate space 50*a* and pass between the insulation layers 28*b, c* and keep the door leaf 22 correspondingly warm.

As already indicated above, it is expedient to be able to vary the respective horizontal position of one, several or each layer 28*a-d* of the door leaf 22 in order to be able to adjust the door leaf 22 optimally with regard to the conditions in situ. For this purpose, an adjustable guide device 57, which in the present case comprises multiple guide rollers 58, is provided, by means of which, for at least one, for several or all of the layers 28*a-d*, preferably for the outer layers 28*a, d*, the respective horizontal position of the vertical plane along which the corresponding door leaf layer 28*a-d* is moved during the opening or closing of the door 10 in the door opening plane can be varied.

To adjust the horizontal position of the vertical movement plane of the at least one layer of the door leaf, it is preferably the case that the horizontal position of one or all of the guide rollers of the adjustable guide device is variable.

A further special feature of the invention concerns the winding shafts 18, 20. According thereto, in each case the insulation layer 28*b* or 28*c* respectively assigned to the common winding shaft 18 or 20 respectively, on the one hand, and the (outer) layer 28*a* or 28*d* respectively adjacent to said insulation layer, on the other hand, are fastened to the winding shaft 18 or 20 respectively in different positions of the winding shaft as viewed in the circumferential direction of the latter. In the present exemplary embodiment, the respective layers 28*a*, 28*b* and 28*c*, 28*d* are arranged or fastened in receptacles 60*a*, 60*b* which are spaced apart from one another in the circumferential direction.

LIST OF REFERENCE SIGNS

10 Door
12 Side part
14 Side part
16 Winding shaft housing
18 Winding shaft
20 Winding shaft
22 Door leaf
24 Gearing unit
26 Spacer
26*a* Spacer part
26*b* Spacer part
28*a*-28*d* Webs
30 Front side

32 Rear side
34 Lateral edges
36 Lateral edges
38 Termination part
40 Underside
46 U-shaped edge part
48 U-shaped edge part
49 Transverse web part
50*a-c* Intermediate spaces
52 Lower edge
54 Lower edge
56 Contact surface
57 Guide device
58 Rollers
60*a, b* Receptacles

What is claimed is:

1. A vertical-lift door for closing an opening in a wall which separates two different temperature zones from one another, comprising:

a) a movable, flexible door leaf (22) comprising multiple separate, flexible door leaf layers (28*a,b,c,d*) that are guided such that the flexible door leaf layers (28*a,b,c,d*) are spaced apart from one another in a closed state of the door (10), wherein the door leaf layers (28*a,b,c,d*) comprise two outer layers (28*a,d*) and two insulation layers (28*b,c*) that are arranged between the two outer layers (28*a,d*); and b) two winding shafts (18, 20) onto which the door leaf layers (28*a,b,c,d*) can be wound up in order to open the door (10), wherein:

i) at least one of the two winding shafts (18, 20) is arranged in a winding shaft housing (16), ii) a first of the two insulation layers (28*b*) and a first of the two outer layers (28*a*) adjacent to the first insulation layer wind up onto a first of the two winding shafts (18) in the open state of the door, and the first insulation layer and the first outer layer laterally delimiting a first air-filled intermediate space (50*b*) between the first insulation layer (28*b*) and the first outer layer (28*a*) in the closed state of the door, and iii) a second of the two insulation layers (28*c*) and a second of the two outer layers (28*d*) adjacent to the second insulation layer wind up onto a second of the two winding shafts (20) in the open state of the door, and the second insulation layer and the second outer layer laterally delimiting a second air-filled intermediate space (50*c*) between the second insulation layer (28*c*) and the second outer layer (28*d*) in the closed state of the door, c) a mechanical drive for operating the two winding shafts (18, 20) by causing the rotation of the two winding shafts (18, 20) whereby the first insulation layer (28*b*) and the first outer layer (28*a*) adjacent to the first insulation layer (28*b*) wind up onto the first winding shaft (18) in the open state of the door and wind down off of the first winding shaft (18) in the closed state of the door, and whereby the second insulation layer (28*c*) and the second outer layer (28*d*) adjacent to the second insulation layer (28*c*) wind up onto the second winding shaft (20) in the open state of the door and wind down off of the second winding shaft (20) in the closed state of the door, the mechanical drive being of a type that generates waste heat during operation of the mechanical drive to move the door from the open state to the closed state and vice versa, and to any state in between the open state and the closed state, wherein the winding shaft housing (16) comprises heat insulating material, and wherein the mechanical drive is located in the winding shaft housing (16) in mechanical communication with at least one of the two windings shafts (18, 20), and wherein the mechanical drive comprises a motor for driving at least one of the two winding shafts (18, 20), wherein the heat insulating material of the winding shaft housing (16) and the two insulation layers (28*b,c*) are configured to allow a portion of the generated waste heat to pass from the winding shaft housing (16) into a third air-filled intermediate space (50*a*) between the two insulation layers (28*b,c*), whereby the portion of the waste heat provides enough heat to the door leaf (22) to keep the door leaf (22) free from ice; and wherein, along the two insulation layers (28*b,c*) opposite the two winding shafts (18, 20), the two insulation layers (28*b,c*) are connected by at least one spacer (26), and the at least one spacer ensures a spacing between the two insulation layers (28*b,c*) in the closed state of the door (10).

2. The door according to claim 1, wherein each of the two insulation layers has a respective width, wherein the spacer (26) extends substantially along the respective widths of the two insulation layers (28*b,c*).

3. The door according to claim 2, wherein the spacer (26) extends substantially parallel to lower ends of the two insulation layers (28*b,c*) opposite the two winding shafts (18, 20).

4. The door according to claim 2, wherein the spacer (26) is arranged between the two insulation layers (28*b,c*).

5. The door according to claim 2, wherein the spacer (26) comprises two elongate spacer parts (26*a,b*), wherein a first of the spacer parts (26*a*) is located on a side of the first insulation layer (28*b*) that faces toward the second insulation layer (28*c*), and a second of the spacer parts (26*b*) is arranged on a side of the second insulation layer (28*c*) that faces toward the first insulation layer (28*b*), and wherein the two spacer parts (26*a,b*) are connected to one another by way of at least one separate connecting part (49) that is fixedly or detachably connected to the two spacer parts (26*a*, 26*b*).

6. The door according to claim 5, wherein the two winding shafts (18, 20) are located parallel to each other on opposite sides of the door (10).

* * * * *